United States Patent [19]

Mead

[11] Patent Number: 4,735,319

[45] Date of Patent: Apr. 5, 1988

[54] PORTABLE SHOE SHINE KIT

[76] Inventor: F. Jerome Mead, 37 Clinton Pl., Morristown, N.J. 07960

[21] Appl. No.: 942,253

[22] Filed: Dec. 16, 1986

[51] Int. Cl.[4] ..... B65D 69/00; A47L 23/16

[52] U.S. Cl. ..... 206/577; 206/223; 206/229; 15/265

[58] Field of Search ..... 206/223, 577, 225, 229, 206/230; D3/30.5; 248/165; 15/265; 150/113, 117; 190/103, 110, 111, 112

[56] References Cited

U.S. PATENT DOCUMENTS

| | | | |
|---|---|---|---|
| 2,754,870 | 7/1956 | Glantz et al. | 206/579 |
| 2,768,404 | 10/1956 | Frank | 15/265 |
| 2,957,194 | 10/1960 | Ross | 15/265 |
| 2,961,685 | 11/1960 | Aiken | 15/265 |
| 2,991,495 | 7/1961 | Blalack | D3/30.5 |
| 3,696,850 | 10/1972 | Rosenblum | 190/110 |
| 4,010,922 | 3/1977 | Heller et al. | 248/165 |
| 4,135,331 | 1/1979 | Lamlee | 206/815 |
| 4,212,377 | 7/1980 | Weinreb | 190/111 |
| 4,317,519 | 3/1982 | Talley | 206/577 |
| 4,506,769 | 3/1985 | Franco et al. | 190/112 |

*Primary Examiner*—Stephen Marcus
*Assistant Examiner*—T. Graveline
*Attorney, Agent, or Firm*—Daniel H. Bobis

[57] ABSTRACT

A portable shoe shine kit adapted for travel and home use has a container and operatively associated footrest assembly which is removably stored therein. The container defines a storage space which has a partition therein for dividing the storage space into an upper compartment and a lower compartment and the partition has an opening to provide communication between the upper compartment and lower compartment. The footrest assembly includes, a base, a footrest bracket, and an elongated support for connecting the footrest bracket and the base to each other. The base is disposed in the lower compartment of the container and has a connecting member thereon aligned with the opening in the partition to permit the elongated member and the footrest bracket to be connected thereto without removing the base from the container and to position the footrest bracket exterior of the container a spaced predetermined distance generally above the base. The container is made of a flexible but durable material and will be so sized that the footrest bracket and shoe shine polishes and implements can be stored therein. An elongated exterior compartment can be provided on the container for the elongated support. The container and the footrest assembly can be used independently of each other. The container and footrest assembly as above described werein the container and footrest assembly are made and designed so that the shoe shine kit is relatively light and therefore easily portable.

7 Claims, 4 Drawing Sheets

PORTABLE SHOE SHINE KIT

BACKGROUND OF THE INVENTION

This invention relates generally to a shoe shine kit and more particularly to a portable generally composite form of shoe shine kit having a container and an operatively associated and removable footrest assembly therein together with the shoe shining polishes, implements, and the like items necessary for polishing and shining shoes.

Shoe shining outfits or kits in which the container and an associated shoe shining footrest are combined are known as is shown by U.S. Pat. Nos. 652,807; 1,693,601; 2,356,029; 2,463,141; 2,667,658; 2,957,194 and 2,991,495. Further in many of these shoe shine kits the container includes space or compartments for the shoe shining items such as the polishes, implements, and the like necessary for shining shoes.

Some of these prior art devices while readily portable cannot be carried in luggage or confined in drawers or cabinets because of their space requirements and therefore do not provide the desired functional needs for modern day living.

The present invention seeks to overcome these problems by providing an improved readily portable, light, and compact, composite container and footrest assembly wherein the container is made from a durable but flexible material having any desired shape so that it can be formed into two inner compartments which are sized as a function of a separator or partition member so that the associated elements of the footrest assembly can be so mounted therein that there is adequate space for shoe shining polishes, implements, and the like materials required for polishing and shining shoes. Suitable resealable openings are provided for removably mounting the elements of the footrest assembly and to permit the footrest assembly to be assembled without removing it from the container.

Those skilled in the art will recognize that a shoe shine kit will have greater use if the container can be used independently of the foot rest assembly and vice versa. Thus, in the present invention the disclosed container can be applied to any use where adjustably spaced compartments are required. Similarly the footrest assembly can be set up as a separate and independent fixture apart from the container and used for example at home for shining shoes.

Those skilled in the art will also recognize that it is not only desirable but preferable to make the portable shoe shine kit in accordance with the present invention in such a manner and from materials that will provide a reltively light unit which will increase portability of the shoe shine kit particularly for travel and home use.

SUMMARY AND OBJECTS OF THE INVENTION

Thus, the present invention covers a portable shoe shine kit including, a container defining a storage space and an operatively associated footrest assembly having, base means, a footrest bracket, and an elongated support means for connecting the base to the footrest bracket so mounted in the container that the footrest assembly can be assembled without removing the base from the container.

Additionally, the present invention covers a portable shoe shine kit as above described in which partition means is disposed in the storage space to divide the storage space into sized upper and lower compartments, the partition means has an opening therein to permit communication between the upper and lower compartment, and the base means of the associated footrest assembly is disposed in the lower compartment so that the elongated support means can be aligned with the opening in the partition means to provide access for connecting the elongated support means to the base members when stored in the lower compartment of the storage space.

Accordingly, it is an object of the present invention to provide an improved portable shoe shine kit adapted for travel and home use.

It is an object of the present invention to provide an improved portable shoe shine kit adapted for travel and home use which has a relatively light construction and/or is made of relatively light materials which will not impair the durability and strength of the device for its intended use.

It is another object of the present invention to provide an improved portable shoe shine kit including a container and an operatively associated footrest assembly having a base means, so mounted therein that the footrest assembly can be assembled without removing the base means from the container.

It is another object of the present invention to provide an improved portable shoe shine kit adapted for home and travel use wherein the container defines a storage space having at least an upper and a lower compartment so sized that an operatively associated footrest assembly and shoe shining polishes, and implements can be mounted therein.

These and other objects and advantages of the present invention will be better understood in the description which follows of a preferred form of the invention when taken with the accompanying drawings and the appended claims setting forth the novel features of the invention.

DESCRIPTION OF A PREFERRED EMBODIMENT OF THE INVENTION

Figure 1:
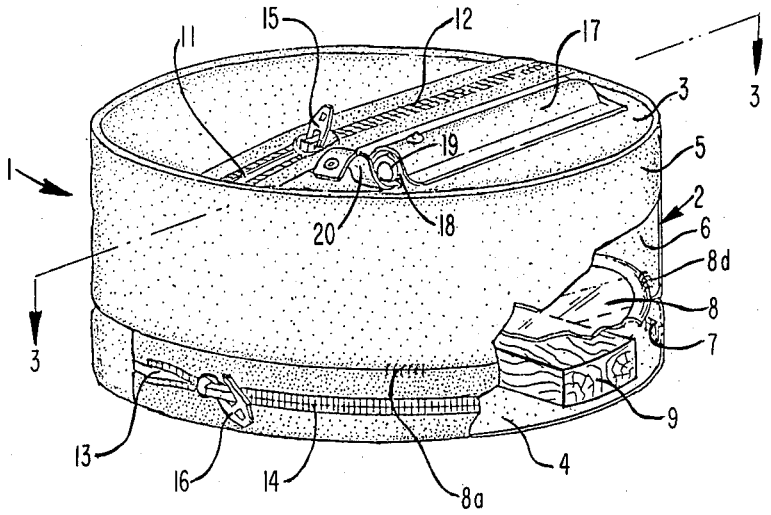
FIG. 1 is a perspective view from one side of the improved container and shoe shine assembly in accordance with the invention partly broken away to show the generally thin planar partition forming the upper and lower compartments in the container and the base member of the footrest assembly in the lower compartment of the container, and further showing a third compartment on the top or upper face of the container for holding the elongated support member of the footrest assembly with the flap closure therefore in open position.
Figure 2:
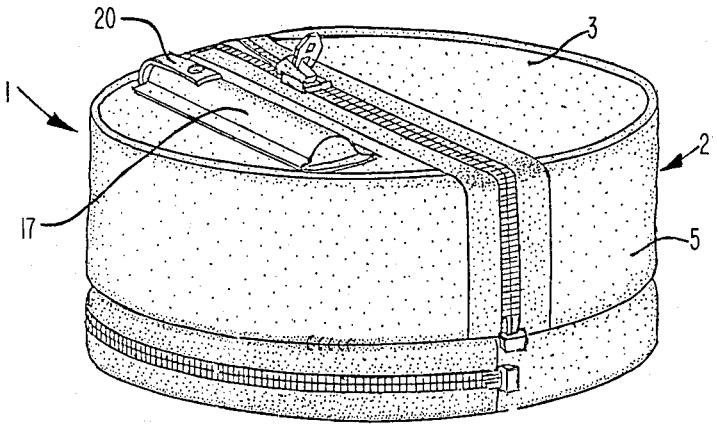
FIG. 2 is a perspective view from another side of the form of the invention shown in FIG. 1 to show the relative length of the resealable openings for the upper and lower compartments in the container, and showing the flap closure for the third compartment in closed position.

Referring to the drawings FIGS. 1 to 5 show an improved portable shoe shine kit assembly generally designated 1 in accordance with the present invention.

The portable shoe shine kit 1 includes, a container 2 is shown as a generally circular cylindrical member. Those skilled in the art will recognize that the container may have any other suitable shape without departing from the scope of the present invention.

The container 2 is preferably made from some type of durable but flexible material such as canvas or synthetic materials such as vinyl and will be sized as small as possible within the space limitations imposed by the size of the footrest assembly generally designated 10 and the shoe shining polishes, implements, and the like used for shining shoes.

The container 2 has a top or upper member 3, a bottom or lower member 4, and a side member 5 which is connected at the opposite ends thereof respectively to the upper member 3 and lower member 4 to form a storage space which is divided into an upper compartment 6 and a lower compartment 7 by means of a generally planar partition member 8.

Figure 3:
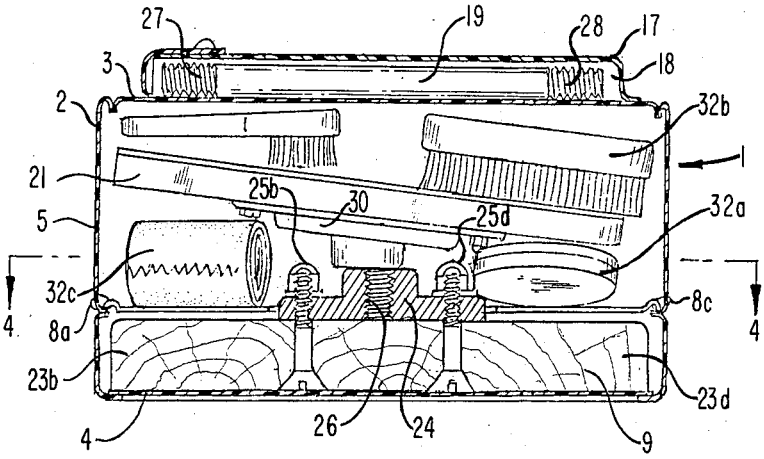
FIG. 3 is a cross-section taken on line 3—3 of FIG. 1.
Figure 4:
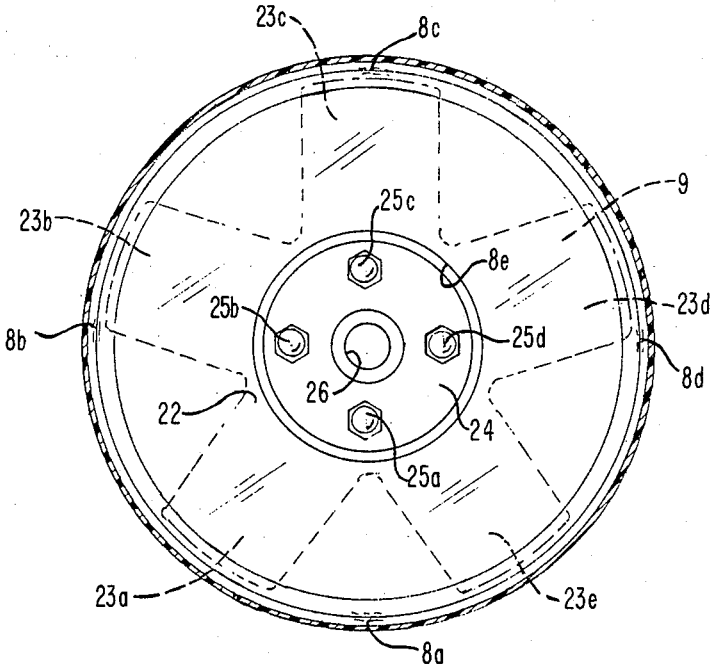
FIG. 4 is a cross-section taken on line 4—4 of FIG. 3.

Partition member 8 takes the same peripheral shape as the inner wall of the storage space defined by the upper compartment 6 and lower compartment 7 and is made of any suitable relatively thin, light but sufficiently strong material so that in assembled position it can support thereon the elements of the shoe shine kit disposed in the upper compartment as is shown in FIGS. 1, 3 and 4 of the drawings.

The partition member 8 is preferably connected at spaced points as at 8*a*, 8*b*, 8*c* and 8*d* to the inner wall of the storage space defined by the upper and lower compartments 6 and 7, first to provide a predetermined volumetric sizing for the respective upper and lower compartments 6 and 7 as can be easily determined from the items to be stored in these compartments, and second to prevent the partition member 8 from collapsing under the weight of the items stored in the upper compartment if the items in the lower compartment are removed. This is shown for example in FIG. 3 where the lower compartment is sized to receive just the base member 9 of the associated footrest assembly generally designated 10, shown at FIGS. 5 and 6 and more fully described below, the element of which together with the shoe shine polishes, and implements are stored in the upper compartment of the container 2.

The partition member 8 is further provided with a central opening 8*e* to provide communication between the upper compartment 6 and lower compartment 7 to enable the elements of the footrest assembly 10 to be connected to each other without removing the base member 9 from the lower compartment 7 of the container, as is more fully described hereinafter.

Access to the upper compartment 6 is provided by an opening 11 in the top or upper member 3 which is normally closed, and is opened and resealed by a conventional zipper type closure member 12. While the opening 11 is shown in the top member 3 those skilled in the art will recognize that the opening for the upper compartment 6 can be placed in the side member 5 at a point adjacent to the top or upper member 3 to provide the necessary access to the upper compartment. Similarly the lower compartment 7 is also provided with an opening 13 which is normally closed, and is opened and resealed by a conventional zipper type closure member 14. It will be understood that other types of closure members for the access openings 11 and 13 may be used without department from the scope of the present invention.

Thus, when it is desired to gain access to the respective upper and lower compartments the associated closure members 12 and 14 are moved to open position by means of their respective releasing members 15 and 16 for opening and closing the closure members 12 and 14.

A piece of elongated and sized material 17 is affixed by any suitable means such as sewing, adhering or bonding the same preferably to the upper member 3 to define a third or exterior compartment 18 for holding the elongated support or connecting member 19 of the footrest assembly 10. The third compartment 18 is open at one end and a flap member 20 for opening and closing the end opening as may be required is provided.

Footrest assembly 10 which is stored in the container 2 may be assembled without removing the base member 9 of the footrest assembly from the container 2 or it may be removed and used independently as is shown in FIGS. 1, 3 5 and 6. Footrest assembly 10 includes the base member 9, the elongated support or connecting member 19, and the footrest bracket 21.

Base member 9 is generally flat and circular in shape and will be made of any suitable and preferably light material such as wood, aluminum, or plastic which is sufficiently strong to support the weight of the heaviest shoe and foot that will need to be supported thereon and will be shaped and sized to reduce the overall mass and hence the weight of this member. Thus, as shown in FIGS. 1, 3, 4, 5 and 6 base member 9 has a central hub section 22 and extending radially from the hub section 22 are five spaced side projections 23*a*, 23*b*, 23*c*, 23*d* and 23*e* so spaced that the overall weight of the base member 9 will be reduced by the amount of the material of the base member absent between these side projections. It will be clear to those skilled in the art that the base member 9 can have shapes other than as illustrated in the drawings without departing from the scope of the present invention.

Centrally disposed on the upper face of the base member 9 is a flanged connector 24 which can be connected to the base member by any suitable means such as threaded members 25*a*, 25*b*, 25*c*, and 25*d*. Flanged connector 24 has a threaded bore 26 in which one threaded end 27 of the elongated support or connecting member 19 is removably mounted.

Elongated support 19 which is stored in the third compartment 18 is a sized length of standard steel, aluminum, plastic or the like pipe which is threaded at the opposite ends as at 27 and 28 so that it can be removably connected into the threaded bore 26 as above described and the opposite threaded end 28 can similarly be removably connected into the threaded bore 29 in a second flanged connector 30 attached to the lower or bottom face of the footrest bracket 21 as by suitable means such as the threaded members 31*a*, 31*b*, 31*c* and 31*d*.

Footrest bracket 21 is a flat member having a length and width to support a shoe, not shown, to be shined thereon, all of which is shown in FIGS. 3, 4, 5 and 6 of the drawings.

ANOTHER EMBODIMENT OF THE INVENTION

Figure 6:
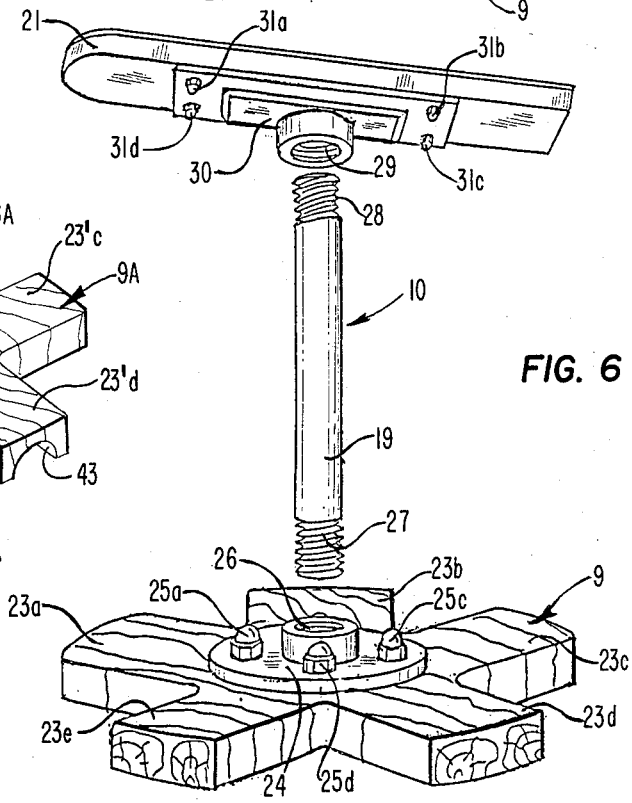
FIG. 6 is an exploded view of the elements of the footrest assembly shown in FIG. 5.
Figure 6A:
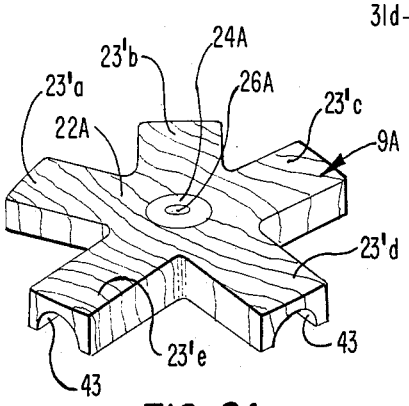
FIG. 6A is a perspective view of a modified form of base member.

FIG. 6A shows a modified form of the invention for reducing the weight of the footrest assembly 10.

This form of the invention is substantially identical with the form of the invention shown in FIGS. 1 to 6 and above described. It differs however in that the base member 9A has each of the spaced side projections 23'*a*, 23'*b*, 23'*c*, 23'*d* and 23'*e* undercut as at 43 to reduce the weight of the base member 9A.

Additionally, instead of the flanged connector 24 as shown in the base member 9 for a footrest assembly 10, the base member 9A is provided with a metal insert fastener 24A which is press fitted into the hub section 22A of the base member 9A. Metal insert fastener 24A will be provided with a threaded bore 26A which is adapted to receive the threaded end 27 of the elongated connecting element 19 as in the first form of the invention above described.

Metal insert fastener 24A will be made of a brass alloy or other light metal alloy and such fasteners are available on the open market and the press fitting of such fasteners into wood, plastic or other materials of which the base member 9A may be made is well known in the art and hence will not be more fully described.

Those skilled in the art will readily recognize that the footrest bracket 21 can also be modified so that a portion thereof is undercut and that the flanged connector 30 can be replaced by a further threaded metal insert fastener, not shown, so as to reduce the weight of the footrest assembly 10 as is illustrated in FIGS. 1 to 6 and which can be modified to cooperate with the modified base member 9A as shown in FIG. 6A of the drawings. Thus, in this modified form of the invention as shown in FIG. 6A, the base and elements of the footrest assembly 10 would be made of sufficiently strong material to permit the footrest assembly to function for the purposes and objects of the present invention.

A FURTHER EMBODIMENT OF THE INVENTION

Figure 7:
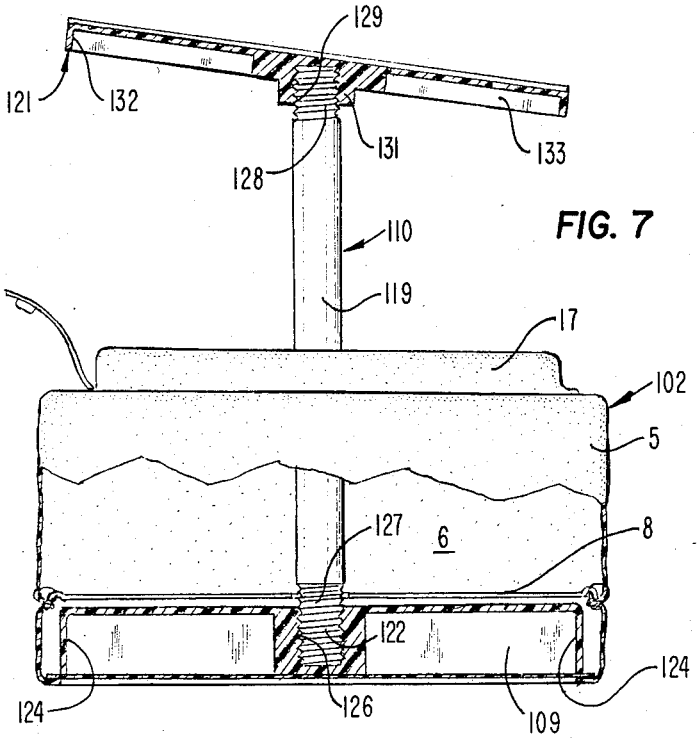
FIG. 7 is a side view of another form of the present invention showing the container partly broken away and showing a modified and lighter form of the footrest assembly assembled relative the container for use.
Figure 8:
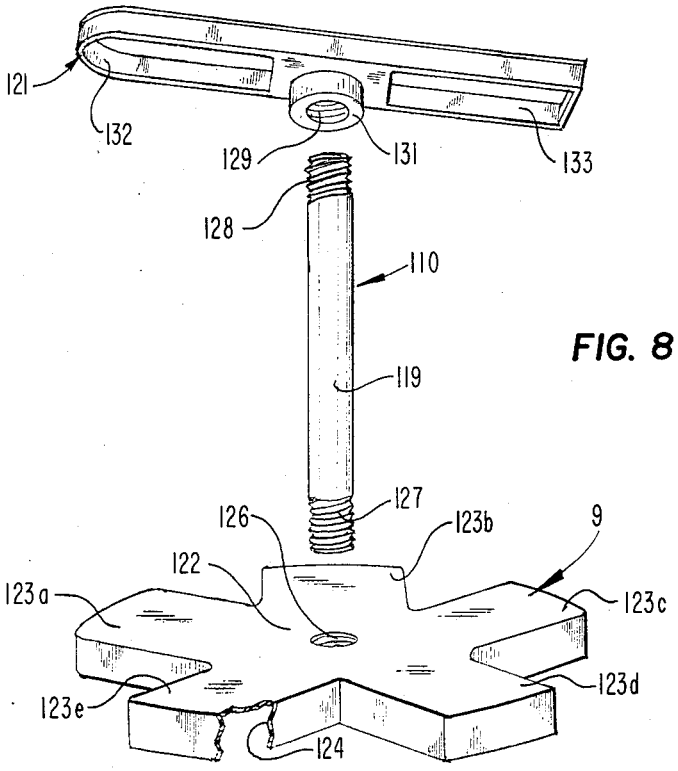
FIG. 8 is an exploded view of the modified and lighter form of the footrest assembly shown in FIG. 7.

FIGS. 7 and 8 show a further modified form of the invention in which the container 102 and the footrest assembly generally designated 110 are also designed to reduce the weight of the shoe shine kit. The container 102 and the footrest assembly 110 are otherwise arranged and disposed for the same operative association as has been above described for the form of the invention shown in FIGS. 1 to 6 of the drawings.

Thus container 102 is shown as being made from a light, durable and flexible cloth material.

Footrest assembly 110 is not only made from light durable polyvinylchloride material but the elements of the footrest assembly namely the base 109, the elongated support or connecting member 119, and the footrest bracket 121 have a design such that portions thereof are cast, formed or undercut removed to eliminate additional weight.

Further, if the material selected and used to cast or form the base member 109, the elongated support or connecting member 119 and the footrest bracket 121 are sufficiently strong, it is possible to eliminate both the flange connector 24 as shown in FIGS. 1 to 6 of the drawings and/or the metal insert fastener 24A as shown in FIG. 6A of the drawings and instead make a threaded bore directly into the base member 109 and the footrest bracket 121 as will now be more fully described.

Thus, the base 109 has the five spaced side projections 123*a*, 123*b*, 123*c*, 123*d*, and 123*e* cast, formed or undercut as at 124 and instead of the flanged connector 24 or the metal insert fastener 24A, a threaded bore 126 is cut, cast or formed in the hub section 122 so that it is in alignment with the central opening 8*e* in the partition member 8 when the base member 109 is in assembled position in the container 102. In this position the threaded bore 126 of the base member 109 is accessible for attachment to the threaded end 127 of the elongated support 119 without the necessity of removing the base 109 from the container 102 in the same manner as was above described for the form of the invention shown in FIGS. 1 to 6 of the drawings.

Elongated support 119 which is stored in the third compartment 118 on the container 102 is a sized length of standard hollow polyvinylchloride tubing which is readily available on the open market. Elongated support 119 is threaded as at 127 at one end and at 128 at the end remote therefrom so that it can be removably connected into the threaded bore 126 as above described and the opposite threaded end 128 can be removably connected into the threaded bore 129 cut, cast or formed in the central portion 131 of the lower or bottom face of the footrest bracket 121.

Footrest bracket 121 as in the first form of the invention is a flat member having a length and width to support a shoe, not shown, to be shined thereon. In this embodiment of the invention the footrest bracket 121 is cast, formed and/or undercut as at 132 and 133 on opposite sides of the central portion 131 in which the threaded bore 129 is formed as above described. Thus, the footrest assembly 110 can be assembled either in operative association with the container 102 in the manner shown in FIG. 7 or it can be removed from the container 102 and used independently thereof in the same manner above described for the form of the invention shown in FIGS. 1 to 6 of the drawings.

It will be clear to those skilled in the art that this form of the invention as shown in FIGS. 7 and 8 provides an even lighter form of the footrest assembly in accordance with the present invention and therefore materially reduces the weight of the shoeshine kit.

When the footrest assemblies 10 or 110 are assembled as shown in the drawings and above described the footrest brackets 21 or 121 will be disposed transversely and at an approximate angle of 10° to the longitudinal line of the assembled footrest assembly 10 and will be spaced a predetermined and convenient distance above the supporting surface on which the containers 2 or 102 are resting to permit the user to shine a shoe or pair of shoes in the conventional manner by using the shoe shining polishes and implements 32*a*, 32*b* and 32*c* disposed in the upper compartment 6 of the respective containers 2 or 102, as is shown in FIG. 3.

Figure 5:
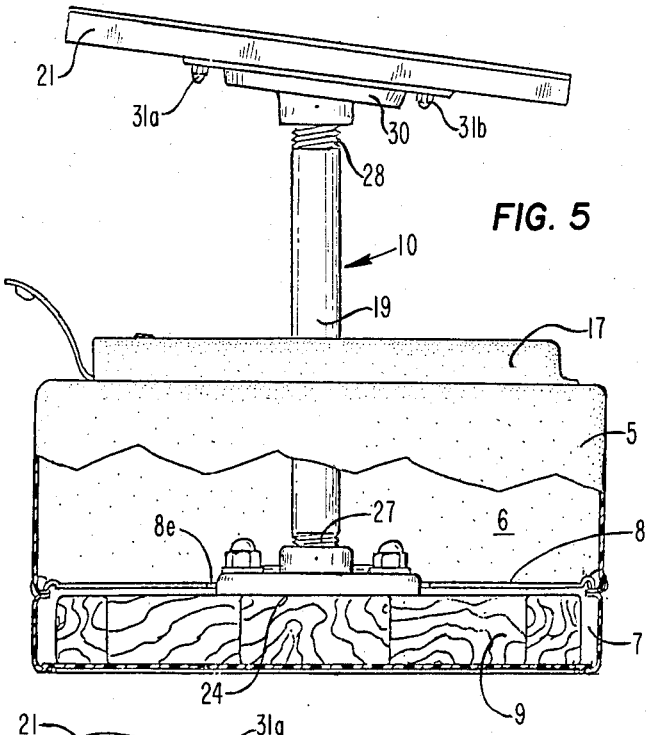
FIG. 5 is a side view of the container partly broken away and showing the footrest assembly assembled relative the container for use.

In the illustrated form of the invention the base member 9 or 109 are disposed in the lower compartment 7 through the access opening 13 by opening the closure member 14 and will be so positioned therein that the bore 26 in the flanged connector 24 or the bore 26*a* in the metal insert fastener 24A on the threaded bore 126 on the members 9, 9A, and or 109 respectively will be aligned with or even extend upwardly into the center opening 8*e* in the partition member 8. This arrangement permits the footrest assembly 10 or 110 to be assembled without removing the base member 9, 9A, or 109 from the container through the access opening 11 by opening the closure member 12 and connecting the elongated support member 19 or 119 to both the base member 9, 9A, or 109 and the footrest bracket 19 or 119 as shown at FIGS. 5 and 7 of the drawings and described above.

OPERATION

In the use of the shoe shine kit in accordance with the present invention, the container 2 or 102 is placed on any suitable and convenient surface and the various elements of the footrest assembly 10 or 110 are connected without removing the base member 9 or 109 from container 2 or 102 as has been above described. The elements of the footrest assembly 10 or 110 are hand tightened and because they are properly sized the footrest bracket 21 or 121 will be at a suitable height to facilitate the placing of the user's shoe on the footrest bracket 21 or 121. The shoe shining polishes and implements 32*a*, 32*b* and 32*c* can now be used to polish the shoe in the conventional manner.

In the illustrated embodiments of the invention if the base member 9 or 109 is about 7" in diameter the container 2 or 102 will have an approximate diameter of 7 ½" and an approximate height of about 3 ½" and depending on the materials used and the design for the footrest assembly 10 or 110 and the number of shoe shining polishes and implements stored in the containers 2 and 102. The entire kit with all elements assembled in the container will have an approximate weight in a range of from 2 to 4 lbs.

With these dimensions for base members 9, 9A, or 109 the associate elongated support members or posts 19 or 119 can be about 7" and the footrest brackets 21 or 121 will be about 6 ⅞" long, 2 ¾" wide and about ½" thick.

Thus, the shoe shine kit in accordance with the present invention can be easily carried or packed as an accessory in most forms of conventional luggage.

Additionally, however, the embodiments of the shoe shine kit as illustrated, described and shown herein can be used both for storing the footrest assembly and the shoe shining polishes and implements or set up independently for home use with the stored shoe shine polishes and implements in the respective containers 2 or 102.

Thus, a simple modern new and compact shoe shine kit has been disclosed which is functional for travel and home use.

It will be understood that the invention is not to be limited to the specific construction or arrangement of parts shown in the respective embodiments illustrated but that they may be widely modified within the invention defined by the claims.

What is claimed is:

1. A portable shoe shine kit comprising:

a. a container means defining a storage space, b. partition means in the container means to form an upper compartment and a lower compartment in the storage space, and having an opening therein to provide communication between said upper compartment and lower compartment, c. footrest means including, base means, footrest bracket means, and an elongated support means, d. said base means removably disposed in the lower compartment of the container, e. means for detachably connecting said elongated support means, said footrest bracket means and said base means to each other without removing the base means from the container means and to hold and dispose the footrest bracket means in assembled position at a point exterior to the container means and a predetermined distance above the base means, f. said means including, a connecting means on said base means for connecting the base means to one end of the elongated support means, and g. said connecting means disposed in alignment with the opening in said partition means to enable the elongated support means to be connected to the base means when in assembled position in the lower compartment.

2. In a portable shoe shine kit as claimed in claim 1 having;

a. a sized exterior compartment formed on the container means, and b. said elongated support member stored in the exterior compartment when the footrest means is disassembled for storage in the container.

3. In a portable shoe shine kit as claimed in claim 1 wherein;

a. said container is made from a relatively strong but flexible material, and b. the partition means is made from a plastic material.

4. In a portable shoe shine kit as claimed in claim 1 wherein;

a. said footrest assembly is made of a light plastic material, and b. the base means of said footrest assembly is formed to reduce the weight thereof.

5. In a portable shoe shine kit as claimed in claim 1 wherein;

a. said footrest assembly is made of a light material, and b. the footrest bracket of said footrest assembly is formed to reduce the weight thereof.

6. In a portable shoe shine kit as claimed in claim 1 wherein;

a. said footrest assembly is made of a light material, b. the footrest bracket and the base have metal insert fasteners press fitted therein, and c. said footrest bracket and said base formed to reduce the weight of said footrest assembly.

7. A portable shoe shine kit comprising:

a. a shaped flexible container means defining a storage space therein, b. partition means in the container means to form an upper compartment and a lower compartment in the storage space, and having an opening therein to provide communication between said upper compartment and lower compartment, c. said container means having a first opening in communication with the first compartment, and means normally maintaining the first opening sealed and for opening and resealing the first opening, d. said container means having a second opening in communication with the second compartment, and means normally maintaining the second opening sealed and for opening and resealing the second opening, e. said first compartment and said second compartment having varying sizes as a function of the location of the partition means in the storage space of the container, f. a footrest assembly removably disposed in the storage space of the container means and including, i. base means having a first threaded bore therein, ii. footrest bracket means having a second threaded bore therein, iii. elongated support means having a first threaded end to be connected into the first threaded bore of said base means, and a second threaded end to be connected into the second threaded bore of said footrest bracket means to connect said footrest bracket means to said base means and hold the same at a predetermined spaced position above the container means, iv. said base means removably disposed in the lower compartment of the container, v. said support means disposed in alignment with the opening in said partition means when the footrest assembly means is in assembled position, g. said footrest assembly means made of relatively light materials and formed so as to reduce the weight of said footrest assembly without sacrificing the stability thereof, and h. a sized exterior compartment formed on the container means for storing the elongated support means when the footrest assembly is disassembled for storage.

* * * * *